US007861980B1

(12) United States Patent
Verbrugge et al.

(10) Patent No.: US 7,861,980 B1
(45) Date of Patent: Jan. 4, 2011

(54) HANGER FOR RAIN GUTTER DEVICE

(76) Inventors: Russell Verbrugge, 90 N. Division Ave., Holland, MI (US) 49424; David Skelton, 3868 Windy Trail Cove, Bartlett, TN (US) 38135; Hal Klaus, 500 Main St., Highland, IL (US) 62249; Robert Heilman, 9051 Eastern Ave., Byron Center, MI (US) 49315

( * ) Notice: Subject to any disclaimer, the term of this patent is extended or adjusted under 35 U.S.C. 154(b) by 70 days.

(21) Appl. No.: 10/904,988

(22) Filed: Dec. 8, 2004

(51) Int. Cl.
*E04D 13/072* (2006.01)

(52) U.S. Cl. ..... 248/48.2; 248/48.1; 52/11

(58) Field of Classification Search ..... 248/48.1, 248/48.2; 52/714, 715, 11, 12, 13, 14, 15
See application file for complete search history.

(56) References Cited

U.S. PATENT DOCUMENTS

| | | | | | |
|---|---|---|---|---|---|
| 453,990 | A | * | 6/1891 | Wock | 248/48.1 |
| 1,414,345 | A | * | 5/1922 | Eeftink | 248/48.2 |
| 2,636,458 | A | * | 4/1953 | Harris | 210/474 |
| 3,053,491 | A | * | 9/1962 | Ramser | 248/48.2 |
| 3,752,428 | A | * | 8/1973 | Trostle et al. | 248/48.2 |
| 3,874,131 | A | * | 4/1975 | Webster | 52/11 |
| 4,404,775 | A | | 9/1983 | Demartini | |
| 4,497,146 | A | | 2/1985 | Demartini | |
| 4,632,342 | A | * | 12/1986 | Skinner | 248/48.2 |
| 4,776,544 | A | * | 10/1988 | Williams | 248/48.1 |
| 4,796,390 | A | * | 1/1989 | Demartini | 52/12 |
| 5,040,750 | A | * | 8/1991 | Brant | 248/48.2 |
| 5,271,192 | A | * | 12/1993 | Nothum et al. | 52/12 |
| 5,333,417 | A | | 8/1994 | Demartini | |
| 5,570,860 | A | * | 11/1996 | Schoenherr | 248/48.2 |
| 5,588,261 | A | | 12/1996 | MacConochie | |
| 5,617,678 | A | * | 4/1997 | Morandin et al. | 52/11 |
| 5,638,643 | A | | 6/1997 | Demartini et al. | |
| 5,737,879 | A | | 4/1998 | Sweet | |
| 5,819,476 | A | | 10/1998 | Annestedt, Sr. | |
| 5,878,533 | A | | 3/1999 | Swanfeld, Jr. | |
| 6,098,345 | A | | 8/2000 | Demartini et al. | |
| 6,134,843 | A | | 10/2000 | Tregear | |
| 6,209,826 | B1 | * | 4/2001 | Pratt, Jr. | 248/48.2 |
| 6,254,039 | B1 | * | 7/2001 | Zimmerman | 248/48.2 |
| 6,543,729 | B1 | * | 4/2003 | Ylonen | 248/48.1 |
| 6,672,012 | B2 | | 1/2004 | Bahroos et al. | |
| 6,978,577 | B2 | * | 12/2005 | Jones | 52/11 |

FOREIGN PATENT DOCUMENTS

GB 2219018 A * 11/1989

* cited by examiner

*Primary Examiner*—A. Joseph Wujciak, III
(74) *Attorney, Agent, or Firm*—Jennifer Meredith, Esq.; Lippes Mathias Wexler Friedman LLP

(57) ABSTRACT

A hanger bracket for a rainwater deflector in a gutter system comprises channels for holding heater cables, flanges and ribs to strengthen the bracket against bending, and a ledge that captures and holds the lip of a gutter without fasteners. Tabs on one side of the bracket engage a panel of the rainwater deflector, while a mounting hole on the other side of the bracket enables the bracket to be mounted to the fascia after the panel is affixed.

11 Claims, 12 Drawing Sheets

HANGER FOR RAIN GUTTER DEVICE

FIELD OF THE INVENTION

The invention relates generally to covers that direct water run-off from a roof of a building to a rain gutter while preventing debris from entering the rain gutter, and more particularly, to hanger brackets that mount such covers to a building.

DESCRIPTION OF THE RELATED ART

A variety of devices have been employed to prevent debris such as leaves and twigs from entering a gutter system. Such debris can clog the gutter preventing water from being properly diverted and over time can cause deterioration of the gutter and the fascia to which the gutter is typically mounted. The prior known gutter covers have included everything from simple screens placed over the top of the gutter to complex devices designed to slow the water flow to ensure entry into the gutter while expelling debris over the outside edge of the gutter.

One of the best operating gutter covers is the Gutter Helmet® cover as substantially disclosed in U.S. Pat. No. 4,404,775. This cover is secured to the roof proximate the gutter such that rainwater flows from the roof onto the gutter cover. The cover includes a radiused outer nose which is positioned over the outer edge of the gutter to ensure that debris is expelled beyond the outer edge. Meanwhile, the radiused nose is designed to direct water into the gutter. The surface tension of the water flowing across the cover causes the flow to follow the radiused nose into the gutter.

Various hanger brackets have been developed to support such gutter covers, which support becomes more important in geographical areas where snow, ice, and high winds place extreme loads on gutter covers. Examples of such hanger brackets can be found in U.S. Pat. Nos. 4,796,390 and 4,497,146 to Demartini, and in U.S. Pat. No. 5,737,879 to Sweet. There remains a need for a hanger bracket that enables easier installation and provides greater strength against extreme loads.

SUMMARY OF THE INVENTION

According to the invention a bracket for affixing a rainwater deflector over a rain gutter on a building comprises a long arm, a short arm extending from a junction with and generally normally relative to the long arm, and a gutter support flange extending at an acute angle from an end of the short arm. All have at least one depending flange to strengthen the bracket against bending. Preferably, the long arm, short arm and gutter support flange each have two oppositely disposed depending flanges. Also, the bracket can have one or more longitudinal ribs on the long arm.

In another aspect of the invention, a bracket assembly for affixing a rainwater deflector over a rain gutter on a building includes a bracket having a long arm, a short arm extending from a junction with and generally normally relative to the long arm, and a gutter support flange extending at an acute angle from an end of the short arm. All have centerlines lying in an imaginary plane. The assembly also includes a brace having a centerline, where the brace is mountable to and between the long arm and the short arm with the brace centerline lying in the imaginary plane. The long arm has at least one tab located on one side of the imaginary plane for holding a rainwater deflector. The short arm has a mounting hole on the other side of the imaginary plane. Thus, the mounting hole can be easily accessed to extend a fastener through it to a fascia on the building after affixing a panel of the rainwater deflector to the tabs. Preferably, the long arm has three tabs on the one side of the imaginary plane. Also, the brace can have one or more mounting holes to receive the fastener. If more than one, any one of them can be selected to receive the fastener.

In yet another aspect of the invention, a bracket for affixing a rainwater deflector over a rain gutter on a building comprises a long arm, a short arm extending from a junction with and generally normally relative to the long arm, and a gutter support flange extending at an acute angle from an end of the short arm. The long arm has at least two channels for receiving and supporting a heater cable. Preferably, one channel is at the junction and another channel is intermediate the junction and the distal end of the long arm. A tab can extend from the junction adjacent the channel.

Finally, a bracket for affixing a rainwater deflector over a rain gutter on a building, comprises a long arm, a short arm extending from a junction with and generally normally relative to the long arm, and a gutter support flange extending at an acute angle from an end of the short arm. The gutter support flange has an inturned ledge adapted to capture and retain a lip of a gutter without fasteners.

DETAILED DESCRIPTION

Figure 1:
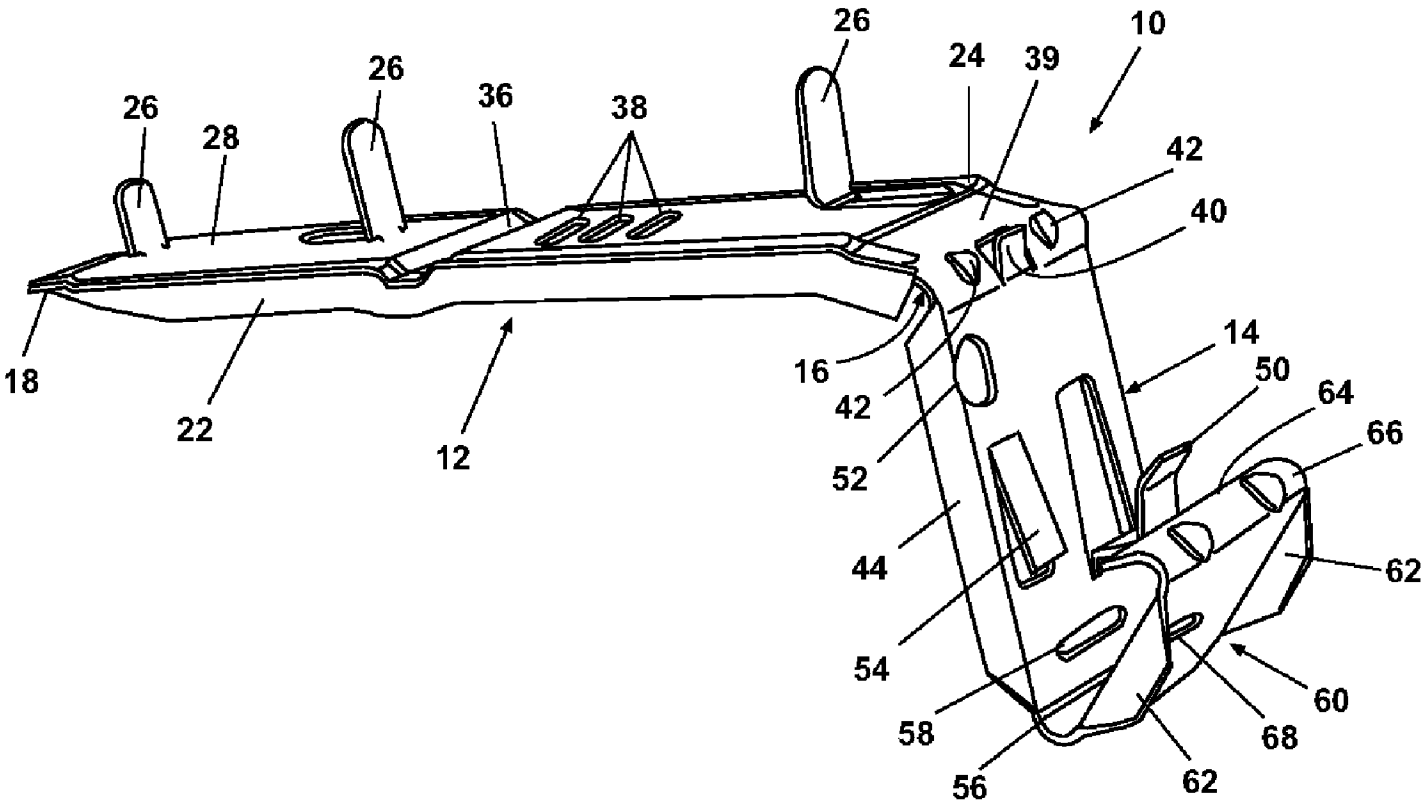
FIG. 1 is a perspective view of a first embodiment of a hanger bracket according to the invention.
Figure 2:
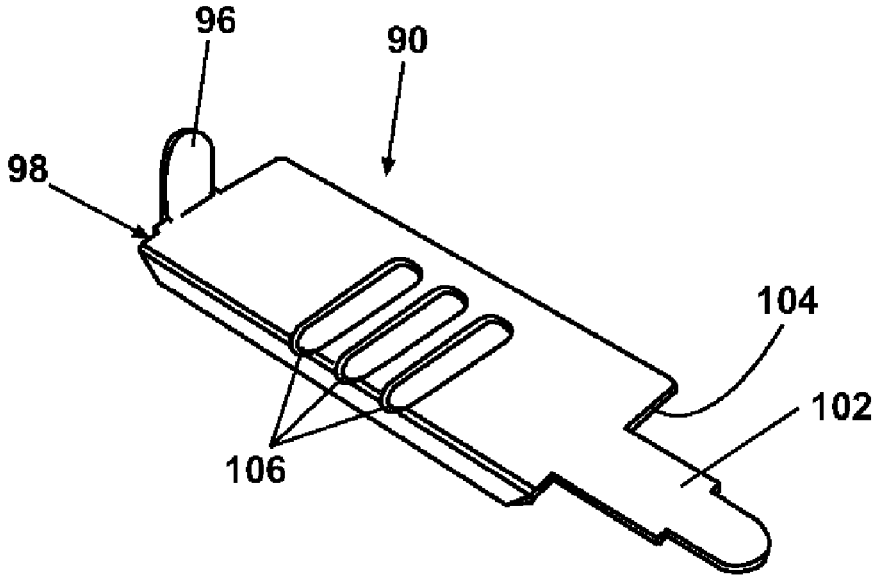
FIG. 2 is a perspective view of an optional brace that can be used with the hanger bracket of FIG. 1.
Figure 3:
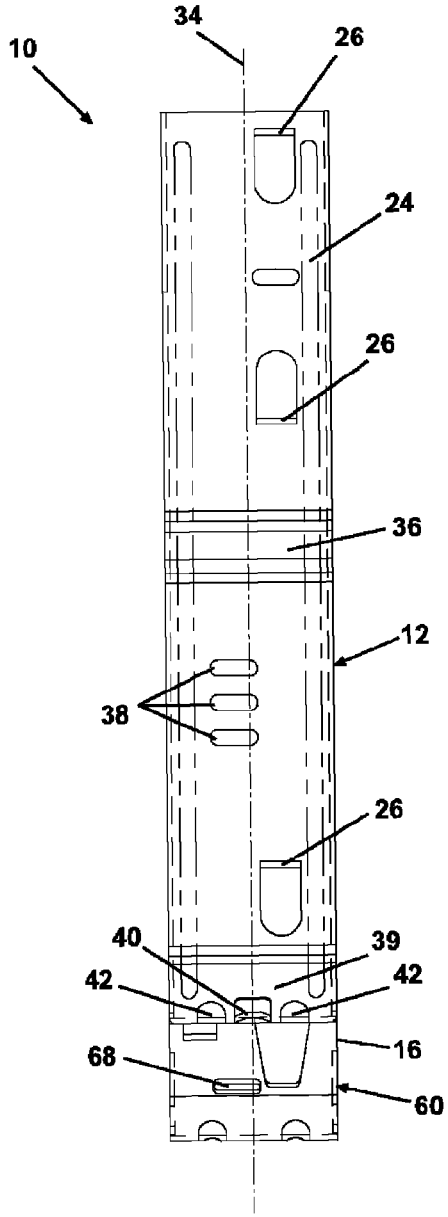
FIG. 3 is a top plan view of the hanger bracket of FIG. 1.
Figure 4:
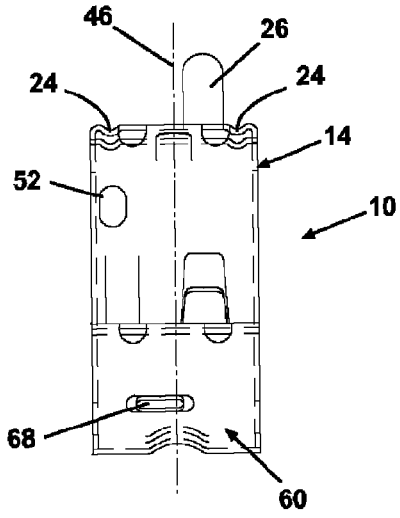
FIG. 4 is a front elevational view of the hanger bracket of FIG. 1.
Figure 5:
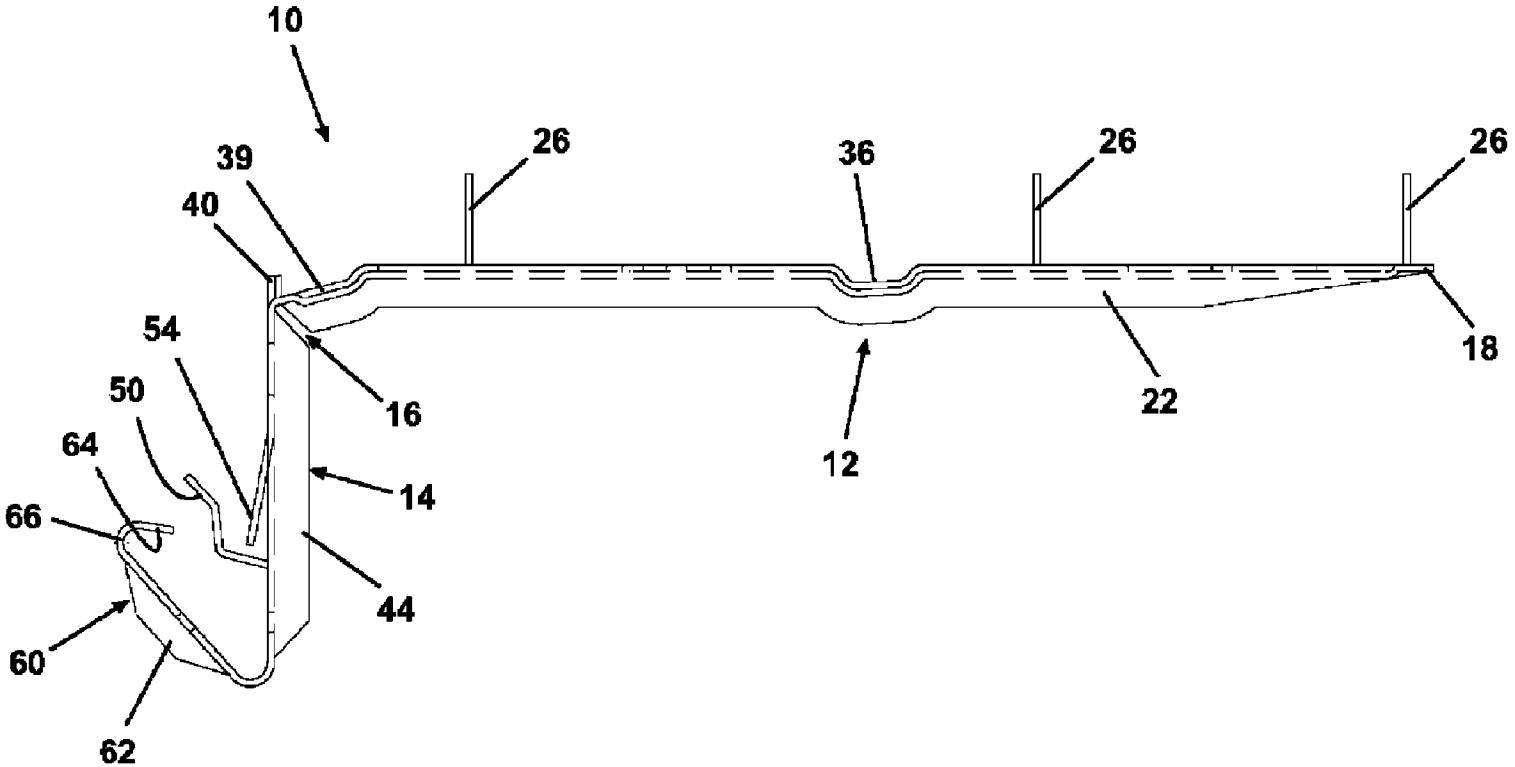
FIG. 5 is a side elevational view of the bracket of FIG. 1.
Figure 6:
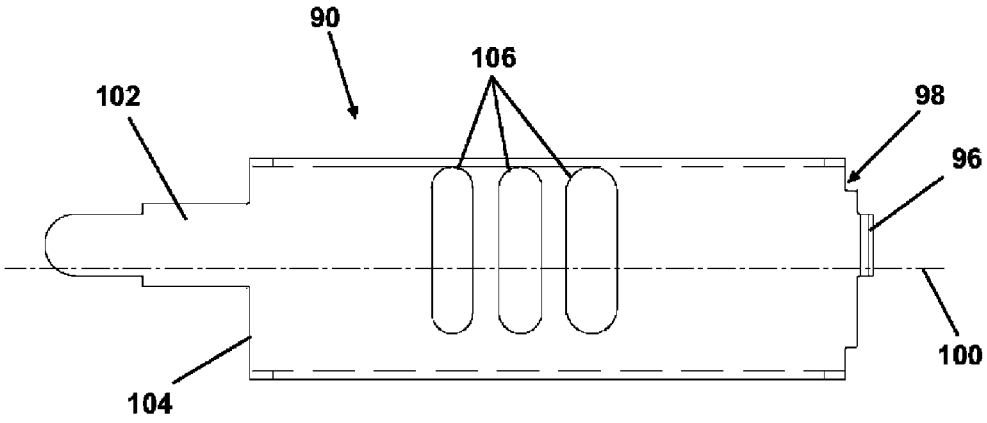
FIG. 6 is a top plan view of the brace of FIG. 2.
Figure 7:
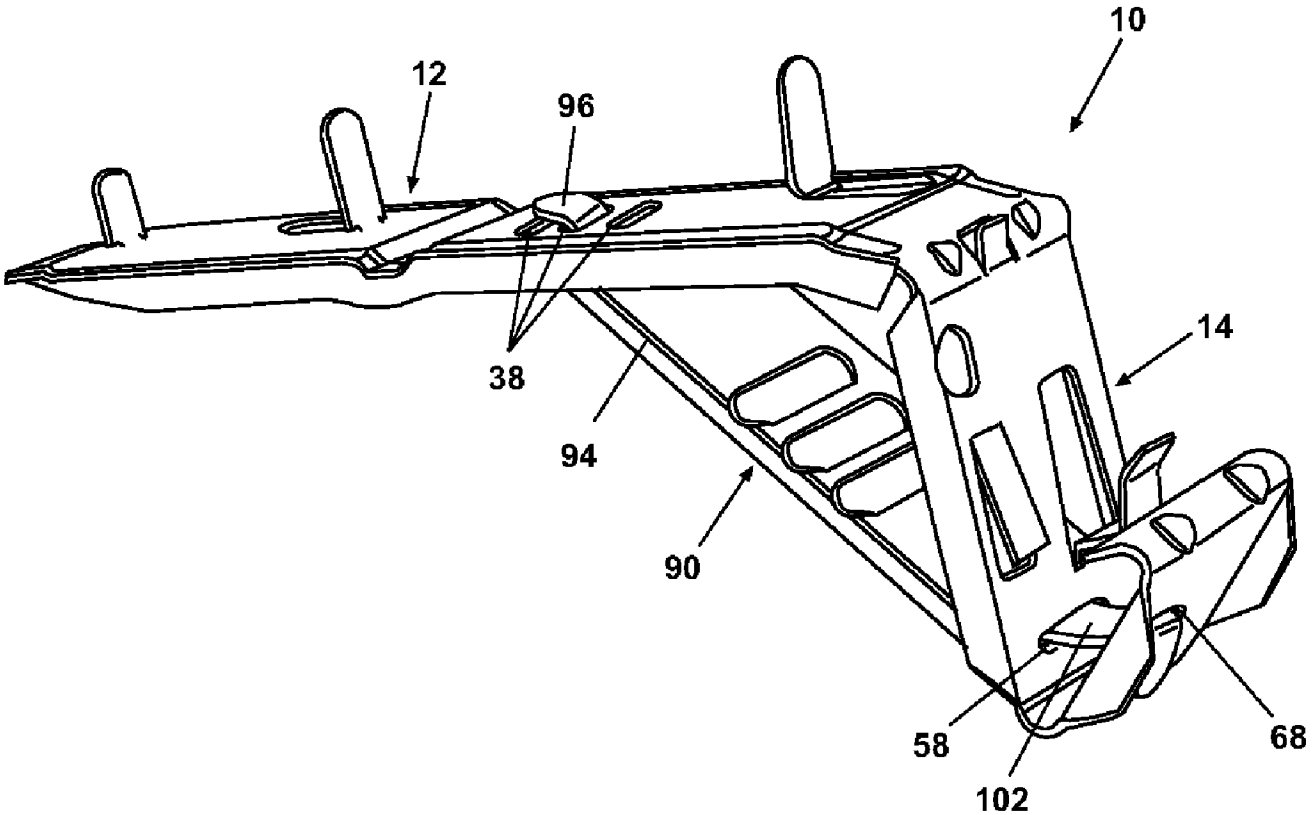
FIG. 7 is a perspective view of the hangar bracket of FIG. 1 assembled with the brace of FIG. 2.

Looking first at FIGS. 1-9, a first embodiment of a hanger bracket 10 according to the invention comprises a long arm 12 and a short arm 14, joined to each other at roughly a 90° angle at a junction 16. The long arm 12 has a distal end 18 that is designed to be located in proximity to or even to rest on an associated roof 20 (see FIGS. 8 and 9). Depending flanges 22 on the longitudinal sides of the long arm 12 provide strength and rigidity and tend to prevent the long arm from bending. Longitudinal ribs 24 or ridges can also be provided in the long arm 12 to assist in providing strength and rigidity.

A plurality of tabs 26 extends upwardly from the long arm 12 so that they are at substantially right angles to the upper surface 28 of the long arm. This facilitates insertion of the tabs through corresponding apertures 30 in a rainwater deflector 32 to be positioned atop the hanger bracket (see FIGS. 8 and 9). Following such insertion, the tabs 26 may be bent over with a wrench or other tool to hold the deflector 32 affixed to the bracket 10, as shown, for example, in FIG. 9. In accord with the invention, the tabs 26 are located off a centerline 34 of the long arm 12 (see FIG. 3).

A lateral channel 36 is disposed in the upper surface 28 of the long arm 12 approximately midway between the distal end 18 and the junction 16. Also, a plurality of lateral slots 38 is located in the long arm 12 on a side of the centerline 34 opposite the tabs 26. A second lateral channel 39 is disposed at the junction 16 of the long arm 12 with the short arm 14. A support tab 40 extends upwardly at the junction 16 adjacent the second lateral channel 38. Small radiuses 42 and on either side of the support tab 40 provide additional strength at the junction 16.

As with the long arm 12, depending flanges 44 on the longitudinal sides of the short arm 14 provide strength and rigidity and tend to prevent the short arm from bending. The short arm 14 has a centerline 46 that is coplanar with the centerline 34 of the long arm 12. Beneath the junction 16 on one side of the centerline 46, and generally in the same plane as the tabs 26, a trapping tab 50 extends outwardly and upwardly. A mounting hole 52 is disposed in the short arm 14 opposite the centerline 46 from the trapping tab 50, and immediately adjacent the depending flange 44 at the edge of the short arm. An outwardly and downwardly extending gripping tab 54 is located beneath the mounting hole 50, opposite the centerline 46 from the trapping tab 50. Between the trapping tab 50 and gripping tab 54 on one side, and the distal end 56 of the short arm 14 on the other side, is a lateral slot 58 mostly on the same side of the centerline 46 as the lateral slots 38 on the long arm 12.

Extending upwardly and outwardly from the distal end 56 of the short arm 14 is a gutter support flange 60, having depending flanges 62 on its longitudinal edges for strength, and an inturned ledge 64 at its terminal end 66. A lateral slot 68 is located in the gutter support flange 60 opposite the lateral slot 58 on the short arm 14.

Preferably, the hanger bracket 10 is made of a lightweight, strong, rust-free material such as aluminum or copper. It can be formed in one or more stamping operations by a die. Looking now more closely at FIGS. 8 and 9, in use, the inturned ledge 64 captures a commonly formed outer edge 70 or lip of a conventional rain gutter 72. The distal end 18 of the long arm 12 rests on the roof 20 and is preferably secured to the roof by fasteners, such as screws. It will be understood that in normal use a plurality of hanger brackets 10 will be disposed along a roof line at spaced intervals, typically one bracket every 2.5 to 5 linear feet of gutter. Heater cables 74 can be laid in the lateral channels 36, 39 of the long arms 12 where they are less prone to move or slide or fall off the bracket 10. A rainwater deflector 32 is positioned atop the hanger bracket 10 and secured to the long arm 12 by the aforementioned tabs 26. An arcuate nose 76 of the rainwater deflector 32 is formed when the terminal edge 78 of the rainwater deflector is trapped by the trapping tab 50. The rainwater deflector 32 is thus securely attached to the hanger bracket 10 in proper position to permit rainwater runoff from the roof 20 to follow the arcuate nose 76 into the gutter 72 by surface tension while its positioning enables debris from the roof 20 to fall off the rain water deflector without entering the gutter.

Looking now at FIGS. 6-9, an optional brace 90 can be mounted between the long arm 12 and the short arm 14 to provide additional strength and support for the hanger bracket 10 as well as for mounting the hanger bracket directly to the fascia 92. The brace 90 can be formed from a flat piece of stock similar in material to the hanger bracket 10, and comprises depending flanges 94 from its longitudinal edges for rigidity and strength. A mounting tab 96 extends from an upper end 98, preferably at a 90° angle, offset from a centerline 100 of the brace. A longer tab 102 extends from a lower end 104, offset from the centerline 100 on the same side as the mounting tab 96. A plurality of lateral slots 106, slightly offset relative to the centerline 100, is located intermediate the upper 98 and lower 104 ends. When the brace 90 is to be mounted to the hanger bracket, the mounting tab is extended to any one of the lateral slots 38 in the long arm 12 and bent to secure it. The longer tab 102 is extended through the lateral slot 58 in the short arm 14 and the lateral slot 68 in the gutter support flange 60 and bent to secure.

Figure 8:
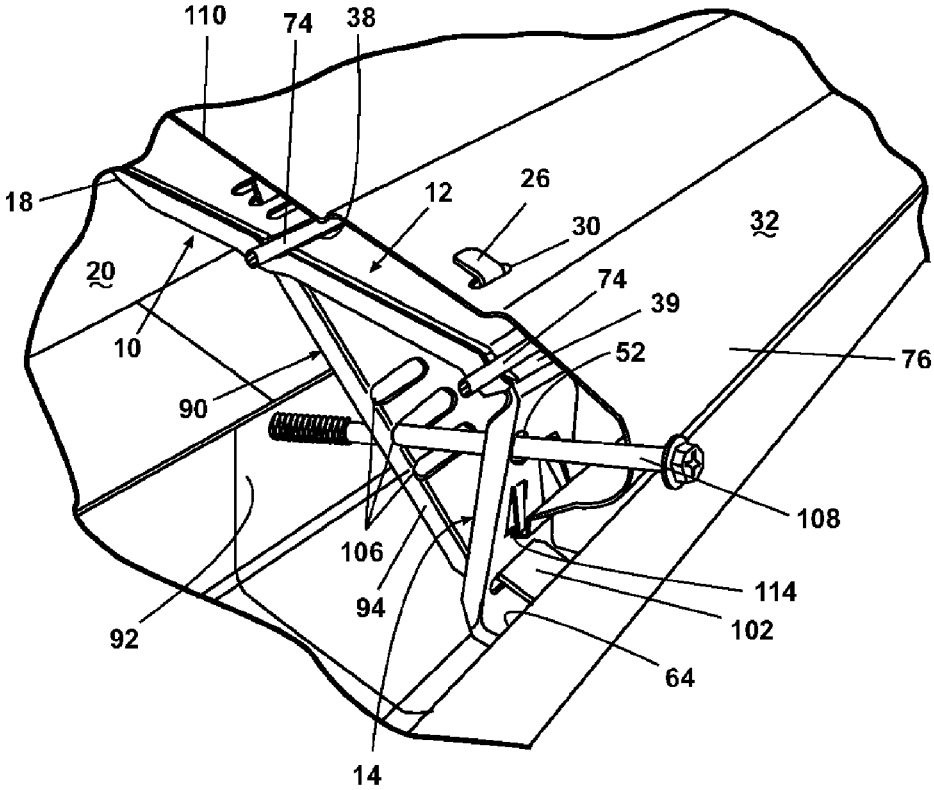
FIG. 8 is a perspective view showing the bracket and brace assembly of FIG. 7 in an installation.
Figure 9:
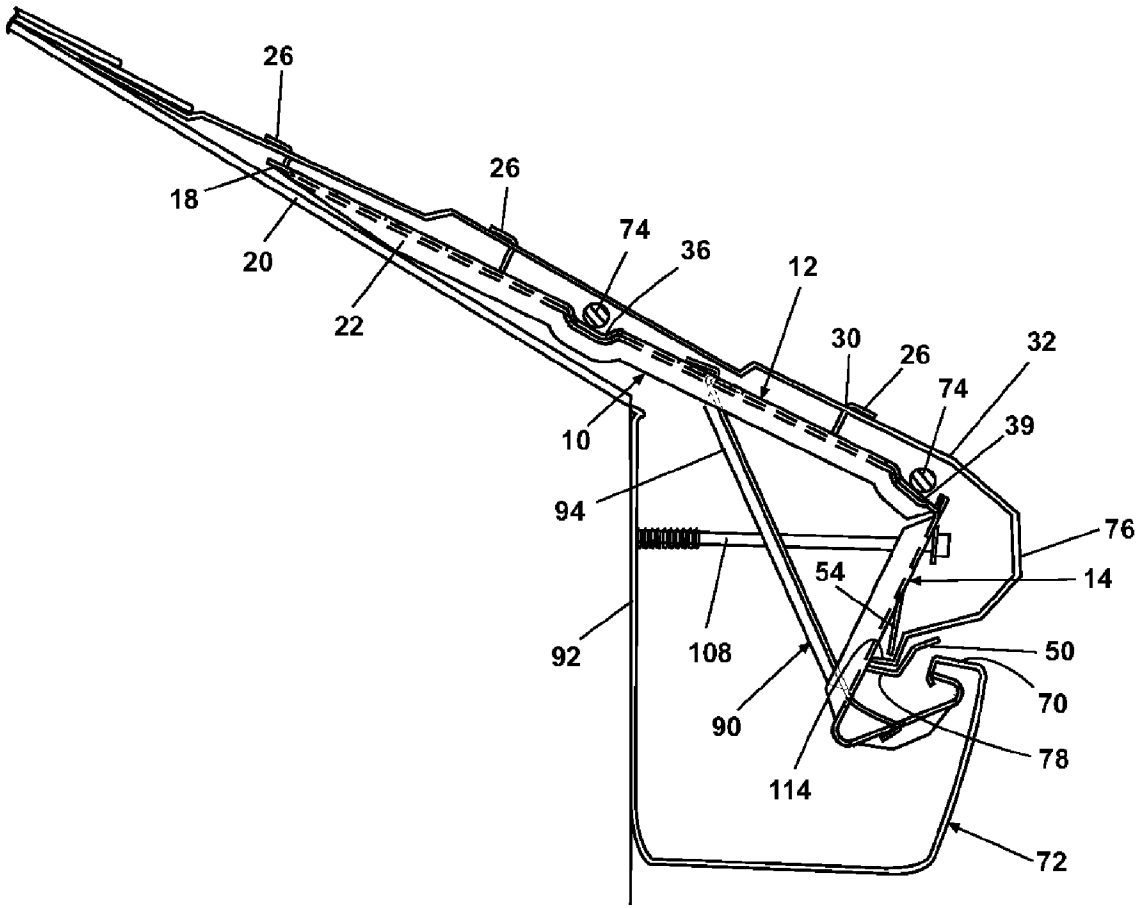
FIG. 9 is an end view, partly in cross section, of the installation of FIG. 8.
Figure 10:
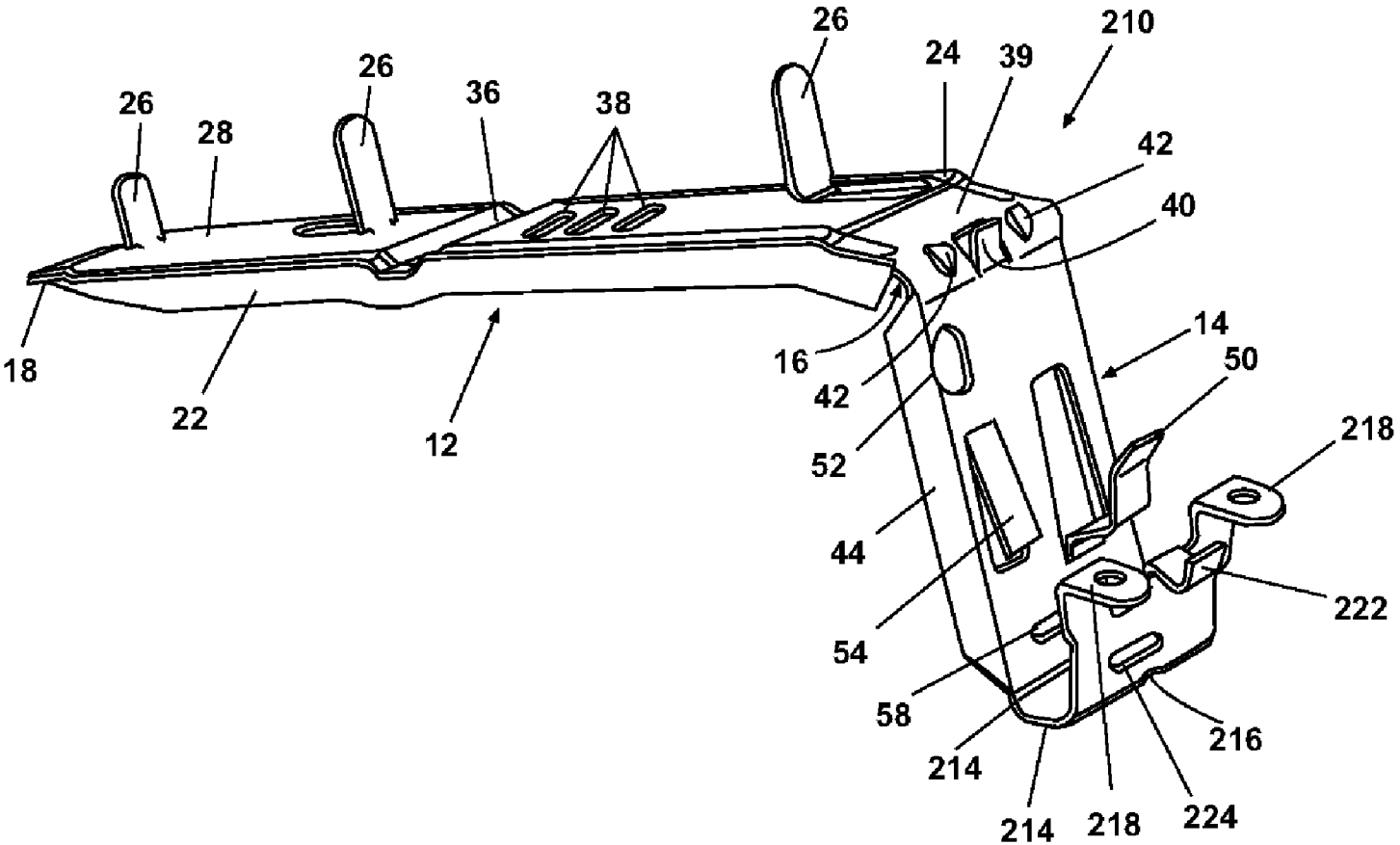
FIG. 10 is a perspective view of a second embodiment of a hanger bracket according to the invention.
Figure 11:
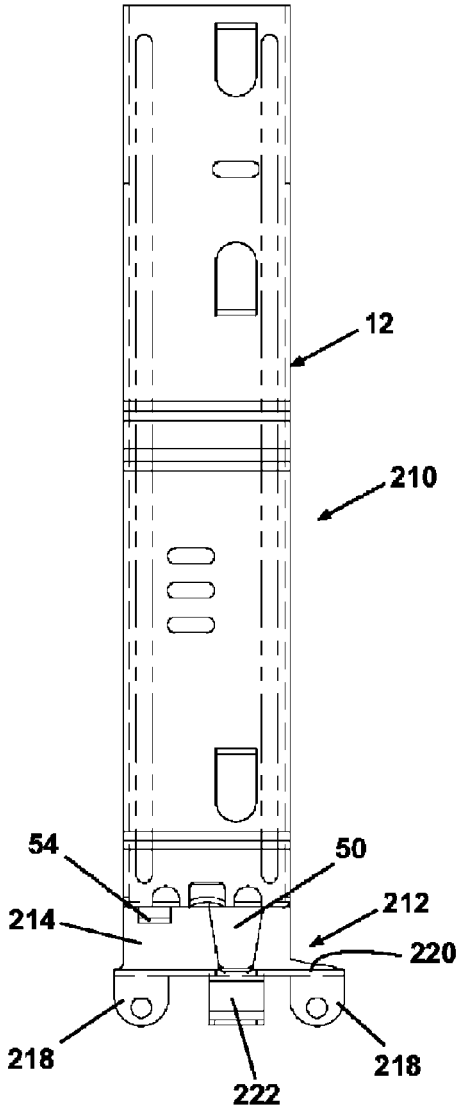
FIG. 11 is a top plan view of the hanger bracket of FIG. 10.
Figure 12:
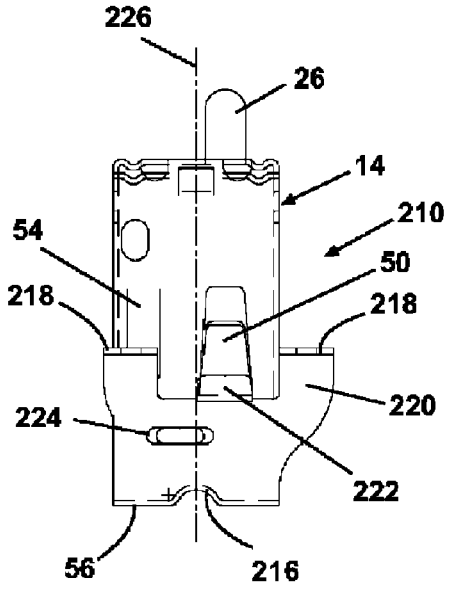
FIG. 12 is a front elevational view of the hanger bracket of FIG. 10.
Figure 13:
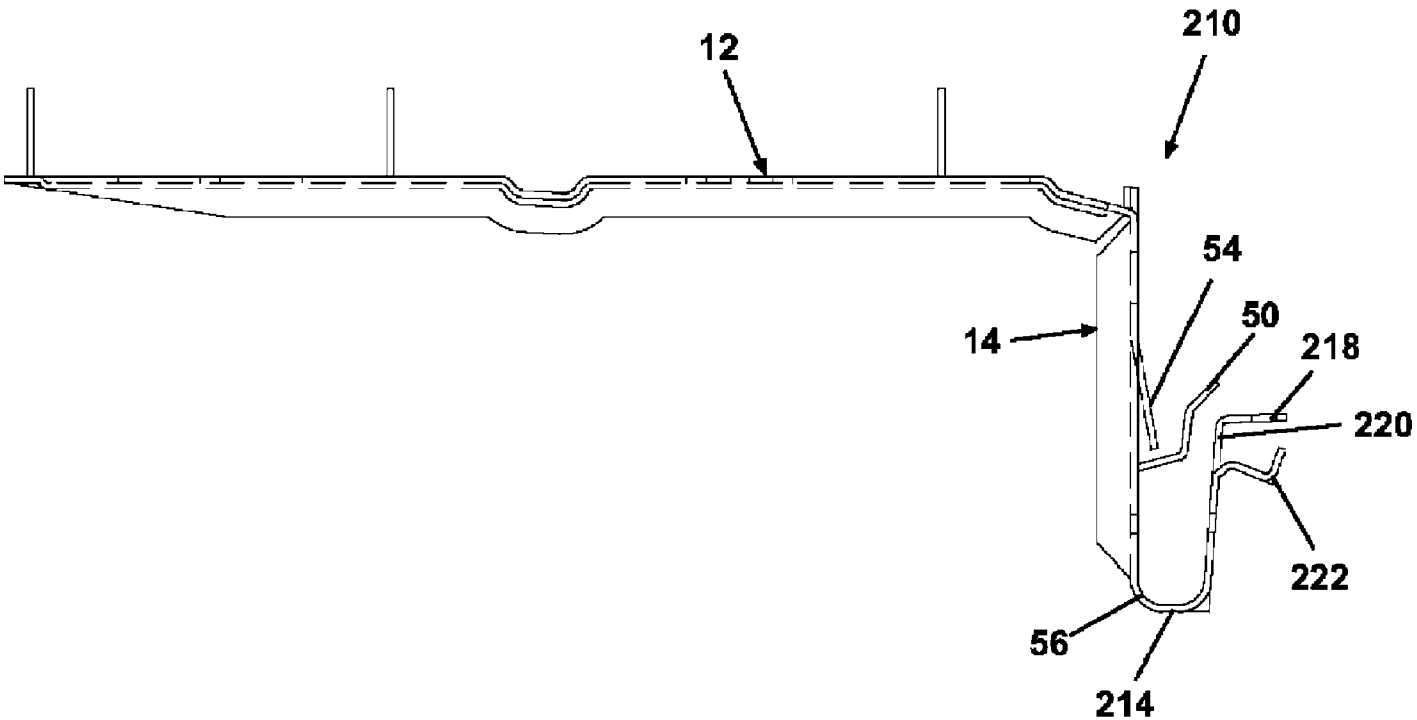
FIG. 13 is a side elevational view of the bracket of FIG. 10.
Figure 14:
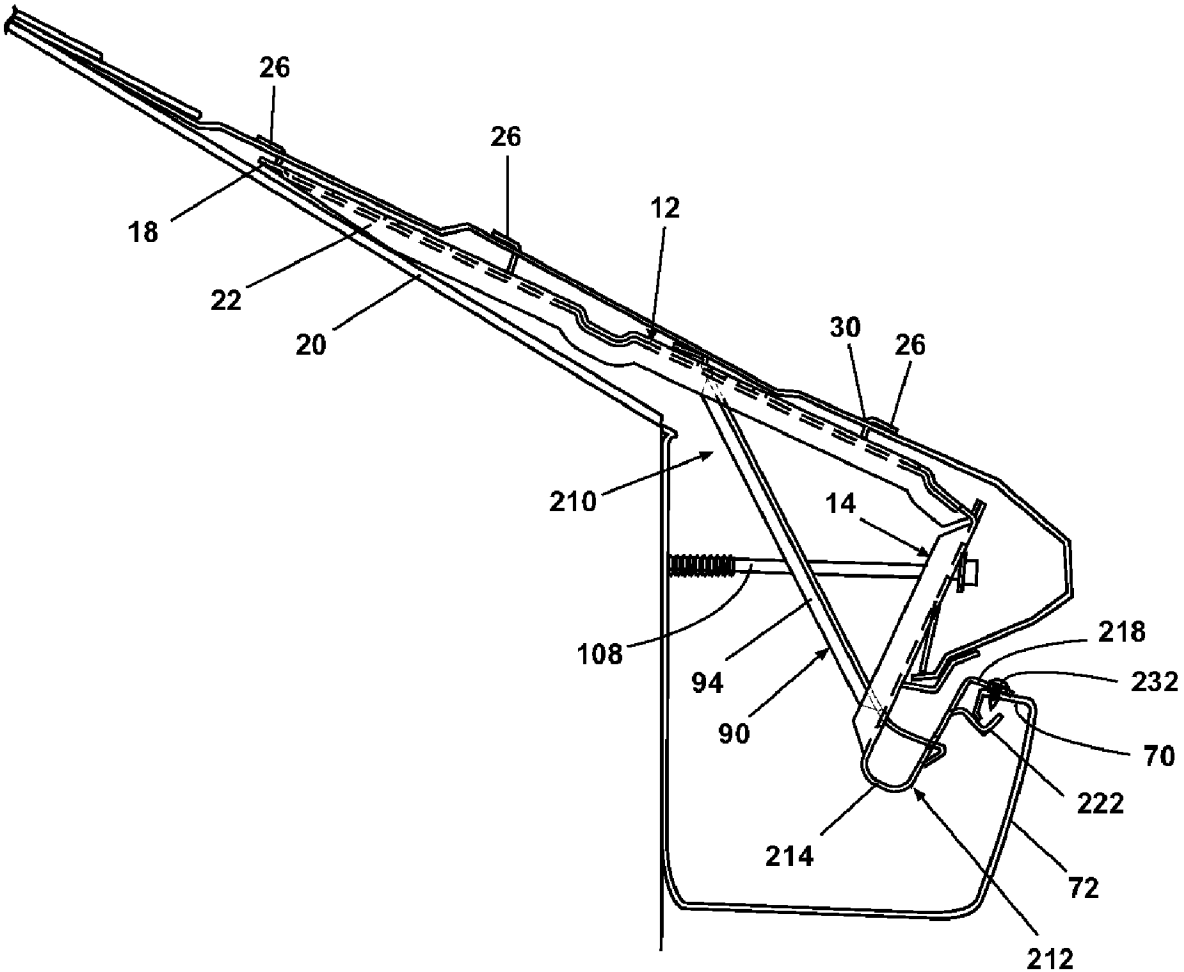
FIG. 14 is an end view, partly in cross section, of the hangar bracket of FIG. 10, assembled with the brace of FIG. 2, in an installation.

Looking again at FIGS. 8 and 9, with this structure, the hanger bracket 10 can be mounted directly to a fascia 92 by extending a fastener, such as a mounting bolt 108, through the mounting hole 52 in the short arm 14 and then through one of the lateral slots 106 in the brace 90 to the fascia. Advantageously, this structure enables an installer to position the bracket 10 and mount it to a fascia 92 by using an existing rainwater deflector panel 32. Here, one edge of a rainwater deflector panel will already be mounted to a hanger bracket, and the other edge will be free. Looking particularly at FIG. 8, a hanger bracket 10 in accordance with the invention assembled to the optional brace 90 can be positioned beneath a free edge 110 of the rainwater deflector panel 32 so that the tabs 26 on the long arm 12 extend through slots 30 in the rainwater deflector panel. The terminal edge 114 of the rainwater deflector panel 32 is trapped by the trapping tab 50. At the same time, the terminal edge 114 is also gripped by the gripping tab 54 so that the rainwater deflector panel 32 is held down against forces tending to lift it, such as wind. The distal end 18 of the long arm 12 is positioned on the roof 20, and the inturned ledge 64 on the gutter support flange 60 captures the outer edge 70 of the rain gutter 72. While in this position, the mounting bolt 108 can be extended through the mounting hole 52 in the short arm 14, and then through one of the lateral slots 106 in the brace 90 to the fascia 92.

A second embodiment of a hanger bracket 210 according to the invention can be seen in FIGS. 10-14. The hanger bracket 210 is identical in all salient respects to the first embodiment, but for the manner in which it connects to a gutter. Thus, like components will bear like numerals to those in the first embodiment 10. The hanger bracket 210 is designed to be a universal bracket, capable of attaching to nearly any type of gutter commonly used in the U.S. Looking now more particularly at FIGS. 10-13, it is seen that the hanger bracket 210 has a gutter support flange 212 that extends from the distal end 56 of the short arm 14 within a few degrees of the plane of the short arm. The gutter support flange 212 is spaced from the short arm 14 by a channel 214 to allow enough room for the gripping 54 and trapping 50 tabs. A lateral radius 216 in the bight portion of the channel 214 strengthens the channel against bending. Two screw tabs 218 extend roughly normally from the terminal end 220 of the gutter support flange 212. A trap tab 222 extends outwardly in the same direction as, and spaced beneath the screw tabs 218. A lateral slot 224 is offset from a centerline 226 of the gutter support flange 212.

The hanger bracket 210 can optionally be assembled to the brace 90 in the same manner as the hanger bracket 10, with the long tab extending through the lateral slot 224. The manner of attachment of the hanger bracket 210 to a rain gutter 72 is illustrated best in FIG. 14. The trap tab 222 is placed beneath the terminal edge flange 70 of the gutter 72. The screw tabs are positioned over the terminal edge flange 230, where sheet metal screws 232 can secure the gutter support flange 212 to the gutter 72.

While the invention has been specifically described in connection with certain specific embodiments thereof, it is to be understood that this is by way of illustration and not of limitation, and the scope of the appended claims should be construed as broadly as the prior art will permit.

What is claimed is:

1. A bracket for affixing a rainwater deflector over a rain gutter on a building, comprising:

a long arm;

a short arm extending from a junction with and generally perpendicular relative to said long arm;

a gutter support flange extending at an acute angle from an end of the short arm, said gutter support flange having at least one depending flange to strengthen the bracket against bending;

an outwardly and downwardly extending gripping tab in said short arm beneath said junction, wherein said gripping tab on said short arm holds a rainwater deflector to said bracket; and an outwardly and upwardly extending trapping tab in said short arm beneath said junction for trapping the rainwater deflector; wherein the long arm is mounted on the surface of building.

2. A bracket for affixing a rainwater deflector over a rain gutter on a building, comprising:

a long arm, wherein said long arm has at least two channels for receiving and supporting a heater cable;

a short arm extending from a junction with and generally perpendicular relative to said long arm;

a gutter support flange extending at an acute angle from an end of the short arm, said gutter support flange having at least one depending flange to strengthen the bracket against bending;

an outwardly and downwardly extending gripping tab in said short arm beneath said junction for holding the rainwater deflector; and an outwardly and upwardly extending trapping tab in said short arm beneath said junction for trapping the rainwater deflector; wherein the long arm is mounted on the surface of building.

3. A bracket for affixing a rainwater deflector over a rain gutter on a building, comprising:

a long arm, wherein said long arm has at least two channels for receiving and supporting a heater cable;

a short arm extending from a junction with and generally perpendicular relative to said long arm, wherein at least one of said at least two channels is at said junction and another channel is intermediate the junction and distal end of said long arm;

a gutter support flange extending at an acute angle from an end of the short arm, said gutter support flange having at least one depending flange to strengthen the bracket against bending;

an outwardly and downwardly extending gripping tab in said short arm beneath said junction for holding the rainwater deflector; and an outwardly and upwardly extending trapping tab in said short arm beneath said junction for trapping the rainwater deflector; wherein the long arm is mounted on the surface of building.

4. A bracket for affixing a rainwater deflector over a rain gutter on a building, comprising:

a long arm, wherein said long arm has at least two channels for receiving and supporting a heater cable;

a short arm extending from a junction with and generally perpendicular relative to said long arm;

a gutter support flange extending at an acute angle from an end of the short arm, said gutter support flange having at least one depending flange to strengthen the bracket against bending;

an outwardly and downwardly extending gripping tab in said short arm beneath said junction for holding the rainwater deflector;

an outwardly and upwardly extending trapping tab in said short arm beneath said junction for trapping the rainwater deflector; and a tab extending from said junction adjacent at least one of the at least two channels; wherein the long arm is mounted on the surface of building.

5. A bracket for affixing a rainwater deflector over a rain gutter on a building, comprising:

a long arm;

a short arm extending from a junction with and generally perpendicular relative to said long arm;

a gutter support flange extending at an acute angle from an end of the short arm, said gutter support flange having at least one depending flange to strengthen the bracket against bending;

an outwardly and downwardly extending gripping tab in said short arm beneath said junction;

an outwardly and upwardly extending trapping tab in said short arm beneath said junction;

a rainwater deflector in communication with said gripping tab, whereby said rainwater deflector can be held to said bracket against wind force tending to lift it up wherein the trapping tab traps the rainwater deflector; wherein the long arm is mounted on the surface of building.

6. A bracket for affixing a rainwater deflector over a rain gutter on a building, comprising:

a long arm;

a short arm extending from a junction with and generally perpendicular relative to said long arm;

a gutter support flange extending at an acute angle from an end of the short arm, said gutter support flange having at least one depending flange to strengthen the bracket against bending;

an outwardly and downwardly extending gripping tab in said short arm beneath said junction for holding the rainwater deflector;

an outwardly and upwardly extending trapping tab in said short arm beneath said junction for trapping the rainwater deflector;

at least one mounting hole in said short arm to receive a fastener, whereby said mounting hole can be easily accessed to extend a fastener through it to a fascia on the building after affixing a panel of the rainwater deflector to said tabs; wherein the long arm is mounted on the surface of building.

7. A bracket for affixing a rainwater deflector over a rain gutter on a building, comprising:

a long arm;

a short arm extending from a junction with and generally perpendicular relative to said long arm;

a gutter support flange extending at an acute angle from an end of the short arm, said gutter support flange having at least one depending flange to strengthen the bracket against bending;

an outwardly and downwardly extending gripping tab in said short arm beneath said junction for holding the rainwater deflector;

an outwardly and upwardly extending trapping tab in said short arm beneath said junction for trapping the rainwater deflector;

a brace mountable to and between said long arm and said short arm further comprising at least two mounting holes in said brace, any one of which can be selected to receive a fastener; wherein the long arm is mounted on the surface of building.

8. A bracket for affixing a rainwater deflector over a rain gutter on a building, comprising:

a long arm;

a short arm extending from a junction with and generally perpendicular relative to said long arm;

a gutter support flange extending at an acute angle from an end of the short arm, said gutter support flange having at least one depending flange to strengthen the bracket against bending;

a brace mountable to and between said long arm and said short arm;

wherein said long arm, said short arm, said gutter support flange and said brace each have centerlines lying in an invisible plane;

an outwardly and downwardly extending gripping tab in said short arm beneath said junction; and an outwardly and upwardly extending trapping tab in said short arm beneath said junction, wherein said gripping tab in said short arm holds a rainwater deflector to said bracket wherein the trapping tab traps the rainwater deflector; wherein the long arm is mounted on the surface of building.

9. A bracket for affixing a rainwater deflector over a rain gutter on a building, comprising:

a long arm having at least two channels for receiving and supporting a heater cable;

a short arm extending from a junction with and generally perpendicular relative to said long arm;

a gutter support flange extending at an acute angle from an end of the short arm, the gutter support flange having at least one depending flange to strengthen the bracket against bending;

a brace mountable to and between said long arm and said short arm;

wherein said long arm, said short arm, said gutter support flange and said brace each have centerlines lying in an invisible plane;

an outwardly and downwardly extending gripping tab in said short arm beneath said junction; wherein the long arm is mounted on the surface of building.

10. A bracket for affixing a rainwater deflector over a rain gutter on a building, comprising:

a long arm having at least two channels;

a short arm extending from a junction with and generally perpendicular relative to said long arm;

a gutter support flange extending at an acute angle from an end of the short arm, the gutter support flange having at least one depending flange to strengthen the bracket against bending;

a brace mountable to and between said long arm and said short arm;

wherein said long arm, said short arm, said gutter support flange and said brace each have centerlines lying in an invisible plane; and an outwardly and downwardly extending gripping tab in said short arm beneath said junction wherein said long arm;

wherein at least one of said at least two channels is at said junction and another channel is intermediate the junction and distal end of the long arm; wherein the long arm is mounted on the surface of building.

11. A bracket for affixing a rainwater deflector over a rain gutter on a building, comprising:

a long arm having at least two channels;

a short arm extending from a junction with and generally perpendicular relative to said long arm;

a gutter support flange extending at an acute angle from an end of the short arm, said gutter support flange having at least one depending flange to strengthen the bracket against bending;

a brace mountable to and between said long arm and said short arm;

wherein said long arm, said short arm, said gutter support flange and said brace each have centerlines lying in an invisible plane;

an outwardly and downwardly extending gripping tab in said short arm beneath said junction wherein said long arm; and a tab extending from said junction adjacent at least one of said at least two channels; wherein the long arm is mounted on the surface of building.

* * * * *